US008568250B2

(12) United States Patent
Chou et al.

(10) Patent No.: US 8,568,250 B2
(45) Date of Patent: Oct. 29, 2013

(54) GOLF BALL WITH COVER HAVING ZONES OF HARDNESS

(75) Inventors: Chien-Hsin Chou, Yunlin County (TW); Chen-Tai Liu, Yunlin County (TW); Yasushi Ichikawa, Tualatin, OR (US); Chia-Chyi Cheng, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 83 days.

(21) Appl. No.: 12/831,940

(22) Filed: Jul. 7, 2010

(65) Prior Publication Data

US 2012/0010025 A1 Jan. 12, 2012

(51) Int. Cl.
*A63B 37/12* (2006.01)
*A63B 37/14* (2006.01)

(52) U.S. Cl.
USPC ..... 473/378; 473/383; 473/377

(58) Field of Classification Search
CPC ..... A63B 37/06; A63B 37/12; A63B 37/14
USPC ..... 473/378, 377, 351, 371, 383
IPC ..... A63B 37/06
See application file for complete search history.

(56) References Cited

U.S. PATENT DOCUMENTS

| | | | | | |
|---|---|---|---|---|---|
| 698,516 | A | * | 4/1902 | Kempshall | 473/370 |
| 726,471 | A | * | 4/1903 | Smith | 473/363 |
| 1,482,232 | A | * | 1/1924 | Hazeltine | 473/377 |
| 1,622,421 | A | * | 3/1927 | Coffield | 473/200 |
| 1,855,448 | A | | 4/1932 | Hazeltine | |
| 2,364,955 | A | * | 12/1944 | Diddel | 473/372 |
| 2,861,810 | A | | 11/1958 | Veatch | |
| 3,031,194 | A | | 4/1962 | Strayer | |
| 4,235,441 | A | | 11/1980 | Ciccarello | |
| 4,660,830 | A | | 4/1987 | Tomar | |

(Continued)

FOREIGN PATENT DOCUMENTS

| | | |
|---|---|---|
| CA | 2728070 | 3/2011 |
| CA | 2775128 | 5/2013 |

(Continued)

OTHER PUBLICATIONS

Extended European Search Report dated Jan. 3, 2012 in European Patent Application No. EP11172727.7.

(Continued)

*Primary Examiner* — Gene Kim
*Assistant Examiner* — Matthew B Stanczak
(74) *Attorney, Agent, or Firm* — Plumsea Law Group, LLC

(57) ABSTRACT

Generally disclosed is a golf ball having a core and a cover layer. The cover layer includes areas that are hard, and areas that are soft. The hard areas make up 20% to 60% of the total surface area of the cover layer, preferably 30% to 50%. The hard areas may correspond to the dimples, while the soft areas may correspond to the land between the dimples. The hard areas may be at least about 3 units on the Shore D scale harder than the soft areas, preferably at least about 5 units. The hard areas may be formed in various geometric shapes, or in the shape of a graphic or logo, and be visibly colored. As a result of the arrangement of the hard areas and the soft areas, the golf ball simultaneously achieves good flight distance and good feel.

12 Claims, 10 Drawing Sheets

(56) References Cited

U.S. PATENT DOCUMENTS

| | | | | |
|---|---|---|---|---|
| 4,863,167 | A | 9/1989 | Matsuki et al. | |
| 5,651,741 | A | 7/1997 | Masutani et al. | |
| 5,783,293 | A * | 7/1998 | Lammi | 428/212 |
| 5,820,485 | A * | 10/1998 | Hwang | 473/361 |
| 5,827,567 | A | 10/1998 | Molitor | |
| 5,836,834 | A * | 11/1998 | Masutani et al. | 473/374 |
| 5,873,796 | A | 2/1999 | Cavallaro et al. | |
| 5,984,806 | A * | 11/1999 | Sullivan et al. | 473/373 |
| 5,984,807 | A * | 11/1999 | Wai et al. | 473/376 |
| 5,994,472 | A | 11/1999 | Egashira et al. | |
| 6,010,442 | A | 1/2000 | Lemons et al. | |
| 6,012,992 | A | 1/2000 | Yavitz | |
| 6,033,611 | A * | 3/2000 | Yamaguchi | 264/250 |
| 6,066,054 | A * | 5/2000 | Masutani | 473/374 |
| 6,103,166 | A | 8/2000 | Boehm et al. | |
| 6,193,617 | B1 | 2/2001 | Mertens | |
| 6,200,239 | B1 * | 3/2001 | Kennedy et al. | 473/604 |
| 6,218,453 | B1 | 4/2001 | Boehm et al. | |
| 6,267,695 | B1 * | 7/2001 | Masutani | 473/377 |
| 6,293,877 | B1 * | 9/2001 | Boehm | 473/371 |
| 6,296,578 | B1 * | 10/2001 | Masutani | 473/368 |
| 6,342,019 | B1 | 1/2002 | Boehm et al. | |
| 6,375,783 | B1 * | 4/2002 | Davis | 156/230 |
| 6,379,270 | B2 * | 4/2002 | Maruko et al. | 473/377 |
| 6,383,091 | B1 | 5/2002 | Maruko et al. | |
| 6,392,002 | B1 | 5/2002 | Wu | |
| 6,398,667 | B1 | 6/2002 | Lemons | |
| 6,422,954 | B1 | 7/2002 | Dewanjee | |
| 6,433,094 | B1 | 8/2002 | Nesbitt et al. | |
| 6,454,666 | B1 | 9/2002 | Shira | |
| 6,464,600 | B2 | 10/2002 | Takemura et al. | |
| 6,485,378 | B1 * | 11/2002 | Boehm | 473/374 |
| 6,508,726 | B1 * | 1/2003 | Yamagishi et al. | 473/378 |
| 6,575,847 | B1 | 6/2003 | Yamagishi et al. | |
| 6,585,607 | B2 | 7/2003 | Tzivanis et al. | |
| 6,629,898 | B2 * | 10/2003 | Nardacci | 473/373 |
| 6,648,776 | B1 | 11/2003 | Boehm et al. | |
| 6,648,778 | B2 | 11/2003 | Sullivan et al. | |
| 6,699,143 | B2 | 3/2004 | Nardacci et al. | |
| 6,743,123 | B2 | 6/2004 | Sullivan | |
| 6,802,787 | B2 | 10/2004 | Ogg | |
| 6,827,657 | B2 | 12/2004 | Sullivan et al. | |
| 6,832,963 | B2 | 12/2004 | Sullivan et al. | |
| 6,835,793 | B2 | 12/2004 | Yokota et al. | |
| 6,955,613 | B2 * | 10/2005 | Ninomiya et al. | 473/367 |
| 7,022,034 | B2 * | 4/2006 | Sullivan et al. | 473/374 |
| 7,041,011 | B2 | 5/2006 | Sullivan et al. | |
| 7,048,656 | B2 | 5/2006 | Litchfield | |
| 7,125,345 | B2 | 10/2006 | Sullivan et al. | |
| 7,160,209 | B2 | 1/2007 | Marotta et al. | |
| 7,195,564 | B2 | 3/2007 | Han | |
| 7,255,655 | B2 | 8/2007 | Gojny | |
| 7,278,930 | B2 | 10/2007 | Yokota et al. | |
| 7,278,931 | B2 | 10/2007 | Manami et al. | |
| 7,429,220 | B2 | 9/2008 | Kuntimaddi et al. | |
| 7,470,203 | B1 | 12/2008 | Stillinger | |
| 7,601,080 | B2 | 10/2009 | Olson et al. | |
| 7,857,716 | B2 * | 12/2010 | Cheng et al. | 473/383 |
| 7,926,645 | B2 | 4/2011 | Contoli et al. | |
| 8,038,329 | B2 * | 10/2011 | Takahasi et al. | 362/373 |
| 8,047,688 | B2 * | 11/2011 | Takahasi et al. | 362/310 |
| 2001/0019969 | A1 | 9/2001 | Binette et al. | |
| 2001/0031668 | A1 * | 10/2001 | Sullivan et al. | 473/351 |
| 2002/0016225 | A1 * | 2/2002 | Maruko et al. | 473/377 |
| 2002/0019269 | A1 | 2/2002 | Watanabe | |
| 2002/0032079 | A1 * | 3/2002 | Maruko et al. | 473/373 |
| 2002/0132684 | A1 * | 9/2002 | Sullivan | 473/355 |
| 2003/0013549 | A1 * | 1/2003 | Rajagopalan et al. | 473/354 |
| 2003/0022731 | A1 * | 1/2003 | Jordan et al. | 473/351 |
| 2003/0083153 | A1 * | 5/2003 | Sullivan et al. | 473/351 |
| 2003/0125134 | A1 * | 7/2003 | Nardacci | 473/371 |
| 2003/0144082 | A1 * | 7/2003 | Rajagopalan et al. | 473/354 |
| 2003/0144087 | A1 * | 7/2003 | Rajagopalan et al. | 473/371 |
| 2003/0153407 | A1 * | 8/2003 | Nardacci | 473/371 |
| 2003/0181260 | A1 * | 9/2003 | Rajagopalan et al. | 473/354 |
| 2004/0132552 | A1 | 7/2004 | Chen | |
| 2004/0209705 | A1 * | 10/2004 | Rajagopalan et al. | 473/354 |
| 2005/0037867 | A1 * | 2/2005 | Ninomiya et al. | 473/371 |
| 2005/0197211 | A1 * | 9/2005 | Sullivan et al. | 473/371 |
| 2005/0255944 | A1 * | 11/2005 | Ninomiya et al. | 473/371 |
| 2006/0058117 | A1 * | 3/2006 | Ninomiya et al. | 473/355 |
| 2008/0064527 | A1 | 3/2008 | Wu et al. | |
| 2008/0081710 | A1 | 4/2008 | Chen et al. | |
| 2008/0251400 | A1 | 10/2008 | Ulrich | |
| 2009/0017941 | A1 | 1/2009 | Sullivan et al. | |
| 2009/0205931 | A1 | 8/2009 | Contoli et al. | |
| 2010/0096992 | A1 * | 4/2010 | Yamamoto et al. | 315/112 |
| 2011/0124438 | A1 * | 5/2011 | Morgan et al. | 473/373 |
| 2011/0177884 | A1 | 7/2011 | Ichikawa et al. | |
| 2011/0177887 | A1 | 7/2011 | Ichikawa et al. | |
| 2011/0177890 | A1 | 7/2011 | Tutmark | |

FOREIGN PATENT DOCUMENTS

| | | | | |
|---|---|---|---|---|
| CN | 101002986 A | 7/2007 | | |
| CN | ZL201120022039.5 | 1/2011 | | |
| CN | 201988125 | 9/2011 | | |
| CN | ZL201120021903 | 2/2012 | | |
| CN | ZL201120237927.9 | 5/2012 | | |
| CN | ZL201110025876.8 | 2/2013 | | |
| EP | 06476147 | 3/1992 | | |
| EP | 2347799 | 1/2013 | | |
| JP | 60-171459 | 11/1985 | | |
| JP | 06277312 | 10/1994 | | |
| JP | 09182814 | 7/1997 | | |
| JP | 11-169486 | * 6/1999 | | A63B 37/12 |
| JP | 2002000765 | 1/2002 | | |
| JP | 2002224241 | 8/2002 | | |
| JP | 2008155013 | 7/2008 | | |
| KR | 1087414 | 11/2011 | | |
| TW | I303180 | 11/2008 | | |
| WO | 9843711 | 10/1998 | | |
| WO | 2008118629 | 10/2008 | | |

OTHER PUBLICATIONS

European Search Report for European Patent Application No. EP12001388.3, mailed on Jul. 3, 2012.

Notification of Grant of Patent Right for Invention for Chinese Invention Patent Application No. 201110025891.2 mailed on Jun. 4, 2013.

Office Action for Japanese Patent Application No. 2011-003995 mailed on Feb. 19, 2013.

Office Action for Japanese Patent Application No. 2011-005928 mailed on Feb. 19, 2013.

Final Office Action for U.S. Appl. No. 12/690,761 mailed Mar. 26, 2013.

Final Office Action for U.S. Appl. No. 12/690,881 mailed Feb. 20, 2013.

Final Office Action for U.S. Appl. No. 13/004,829 mailed Mar. 26, 2013.

Official Letter and Search Report mailed Apr. 19, 2013 for Taiwan Patent Application No. 99145844 and the English translation thereof.

Official Letter and Search Report mailed Apr. 29, 2013 for Taiwan Patent Application No. 100101631 and the English translation thereof.

Response to Final Office Action mailed Mar. 26, 2013 for U.S. Appl. No. 12/690,761, filed May 21, 2013.

Response to Final Office Action mailed Feb. 20, 2013 for U.S. Appl. No. 12/690,881, filed May 20, 2013.

Notice of Allowance mailed May 31, 2013 for U.S. Appl. No. 12/690,881.

Response to Office Action mailed Dec. 13, 2012 for Chinese Invention Patent Application No. 201110025891.2 as filed on Apr. 22, 2013 and the English translation thereof.

Response to Office Action mailed Feb. 19, 2013 for Japanese Patent Application No. 2011-003995 as filed on May 13, 2013 and the English translation thereof.

Initiative Amendment as filed on May 7, 2013 for Chinese Invention Patent Application No. 201210375510.8.

Response to Office Action mailed Feb. 19, 2013 for Japanese Patent Application No. 2011-005928 as filed on May 14, 2013 and the English translation thereof.

(56) References Cited

OTHER PUBLICATIONS

Notice of Allowance for Canadian Patent Application No. 2728070, mailed on Nov. 3, 2011.
Communication under Rule 71(3) EPC for European Patent Application No. 12001388.3, mailed on Jan. 4, 2013.
Office Action for Korean Patent Application No. 10-2011-0005899, mailed on Apr. 25, 2011.
Notice of Decision for Patent for Korean Patent Application No. 10-2011-0005899, mailed on Aug. 23, 2011.
Notification of First Office Action for Chinese Invention Patent Application No. 201110025891.2, issued on Dec. 13, 2012.
Notification of Grant of Patent Right for Utility Model for Chinese Utility Model Patent Application No. 201120022039.5, issued on May 19, 2011.
Office Action for U.S. Appl. No. 12/690,761, mailed on Dec. 18, 2012.
Notification of Grant of Patent Right for Utility Model for Chinese Utility Model Patent Application No. 201120237927.9, issued on Jan. 20, 2012.
Communication under Rule 71(3) EPC for European Patent Application No. 11172727.7, mailed on Jan. 17, 2013.
Extended European Search Report for European Patent Application No. 12001388.3, issued on Jul. 3, 2012.
International Search Report for PCT Application No. PCT/US2011/020996, mailed on Jul. 4, 2011.
Extended European Search Report for European Patent Application No. 11150779.4, issued on May 3, 2011.
Extended European Search Report for European Patent Application No. 11172727.7, issued on Jan. 3, 2012.
Office Action for Canadian Patent Application No. 2,728,070, mailed on May 12, 2011.
Notification of Grant of Patent Right for Invention in Chinese Patent Application No. 201110025876.8, issued Oct. 24, 2012.
Notification of Grant of Patent Right for Utility Model in Chinese Patent Application No. 201120021903.X, issued Dec. 23, 2011.
Communication under Rule 71(3) EPC for European Patent Application No. 11151551.6, mailed May 22, 2012.
Notification of Allowance for Canadian Patent Application No. 2,775,128, mailed Oct. 2, 2012.
Office Action in Utility U.S. Appl. No. 12/690,881, mailed on Nov. 2, 2012.
Office Action in Canadian Patent Application No. 2,728,070, mailed on May 12, 2011.
Notification of First Office Action in Chinese Invention Patent Application No. 201110025876.8, issued on May 2, 2012.
Notification of First Office Action in Chinese Utility Model Patent Application No. 201120021903.X, issued on Jun. 17, 2011.
Notification of Second Office Action in Chinese Utility Model Patent Application No. 201120021903.X, issued on Sep. 6, 2011.
Result of Consultation in European Patent Application No. EP 11151551.6, mailed on May 10, 2012.
Extended European Search Report in European Patent Application No. EP11150779.4, mailed on May 3, 2011.
Communication Under Rule 71(3) EPC for European Patent Application No. EP11150779.4, mailed Jul. 16, 2012.
Office Action in Utility U.S. Appl. No. 13/004,829, mailed on Sep. 17, 2012.

* cited by examiner

GOLF BALL WITH COVER HAVING ZONES OF HARDNESS

BACKGROUND

The present invention relates generally to a golf ball, and a method of manufacturing the golf ball. In particular, a cover layer on the golf ball includes areas having a higher hardness and areas having a lower hardness.

The game of golf is an increasingly popular sport at both the amateur and professional levels. A wide range of technologies related to the manufacture and design of golf balls are known in the art. Such technologies have resulted in golf balls with a variety of play characteristics. For example, different golf balls are manufactured and marketed to players having different golfing abilities, such as different swing speeds.

Similarly, a golfer may use different golf balls having different play characteristics depending on the golfer's preferences. For example, different dimple patterns may affect the aerodynamic properties of the golf ball during flight, or a difference in the hardness of the cover layer may affect the rate of backspin. With regard to hardness in particular, a golfer may choose to use a golf ball having a cover layer and/or a core that is harder or softer. A golf ball with a harder cover layer will generally achieve reduced driver spin, and achieve greater distances. However, a harder cover layer will generally cause a lower rate of spin, such that the golf ball will be better for drives but more difficult to control on shorter shots. On the other hand, a golf ball with a softer cover will generally experience more spin and therefore be easier to control and stop on the green, but will lack distance off the tee. Soft cover layers are generally described as having a good "feel."

A wide range of golf balls having a variety of hardness characteristics are known in the art. Generally, the hardness of a golf ball is determined by the chemical composition and physical arrangement of the various layers making up the golf ball. Accordingly, a number of different golf ball materials are mixed and matched in various combinations and arrangements to create golf balls having different hardness values and different hardness profiles.

However, designing golf balls to achieve desired hardness characteristics suffers from at least several difficulties. Generally, the construction of known golf balls requires that a wide range of design variables such as layer arrangement, materials used in each layer, and layer thickness be balanced against each other. Changes to any of these variables may therefore improve a desired hardness only at the expense of other play characteristics.

For example, the hardness of a cover layer may be controlled by forming the cover layer from a mixture of two or more polymer materials. However, if the cover layer is made from more than one polymer material, the polymers are conventionally mixed or blended together. Such mixing is necessary so that the materials may be used in a compression molding or injection molding process to form the cover layer. Namely, in order to inject a material made from two ionomer resins (such as one resin having a Shore D hardness of 60 and another resin having a Shore D hardness of 40) for a cover layer, known processes necessitate first mixing the two ionomer resins, and then melting the two ionomer resins for injection. During the melting process, the two ionomer resins are so well mixed that the finished product of the cover layer is regarded as one unitary material. Therefore, the play characteristics of the cover layer are limited due to the unitary construction of the cover layer.

Additionally, materials costs and design costs associated with known golf ball constructions may unduly increase the cost of the golf ball to the end consumer. Perhaps most importantly, known golf balls generally cannot simultaneously achieve the advantageous play characteristics associated with high cover hardness (greater distances) while also achieving the advantageous play characteristics associated with low cover hardness (good feel).

Therefore, there is a need in the art for a system and method that addresses the shortcomings of the prior art discussed above.

SUMMARY

In one aspect, the invention provides a golf ball comprising a core and a cover layer substantially surrounding the core; the cover layer including a plurality of dimples thereon, at least one land area separating the dimples, a total surface area, a first portion (the first portion of the cover layer having a first hardness), a second portion (the second portion of the cover layer having a second hardness), the second hardness being different from the first hardness; wherein the first portion consists of multiple non-contiguous zones each surrounded by the second portion; and wherein the first portion encompasses at least 20% of the total surface area of the cover layer; and the first portion encompasses at most 60% of the total surface area of the cover layer.

In another aspect, the present disclosure provides the above mentioned golf ball, wherein each of the multiple zones is associated with one of the plurality of dimples.

Furthermore, the present disclosure provides the above mentioned golf ball, wherein the first hardness is at least about 5 units on the Shore D scale different from the second hardness.

Finally, the present disclosure also provides a method of manufacturing a golf ball, the method comprising the steps of: (1) receiving a golf ball having a core and a pre-cover layer substantially surrounding the core, the pre-cover layer being formed of a first material and having multiple non-contiguous depressions arranged in a pattern corresponding to a desired pattern of zones; (2) molding a second material on top of the pre-cover layer, such that the second material substantially surrounds the pre-cover layer and fills the depressions; (3) grinding the second material away, such that the second material overlaps the pre-cover layer only in the depressions, thereby forming a cover layer having multiple zones of second material; wherein the first material has a first hardness, the second material has a second hardness, the second hardness being different from the first hardness; and wherein the multiple zones of second material encompass at least 20% of a total surface area of the cover layer; and the multiple zones of second material encompass at most 60% of the total surface area of the cover layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION

Generally, the present disclosure relates to a golf ball having first areas on the cover layer that are of one hardness value (such as, relatively hard) and second areas on the cover layer that are of another hardness value (such as, relatively soft). The first areas are non-contiguous zones, each surrounded by the second area, and collectively encompass 20% to 60% of the total surface area of the cover layer. The relatively hard areas may correspond to at least some of the dimples on the cover layer, and the relatively soft areas may correspond to at least part of at least one land area between the dimples. As a result of this arrangement, the golf ball cover layer ensures that the golf ball achieves both long flight distance and good feel.

This disclosure further relates to methods of manufacturing such a golf ball.

Figure 1:
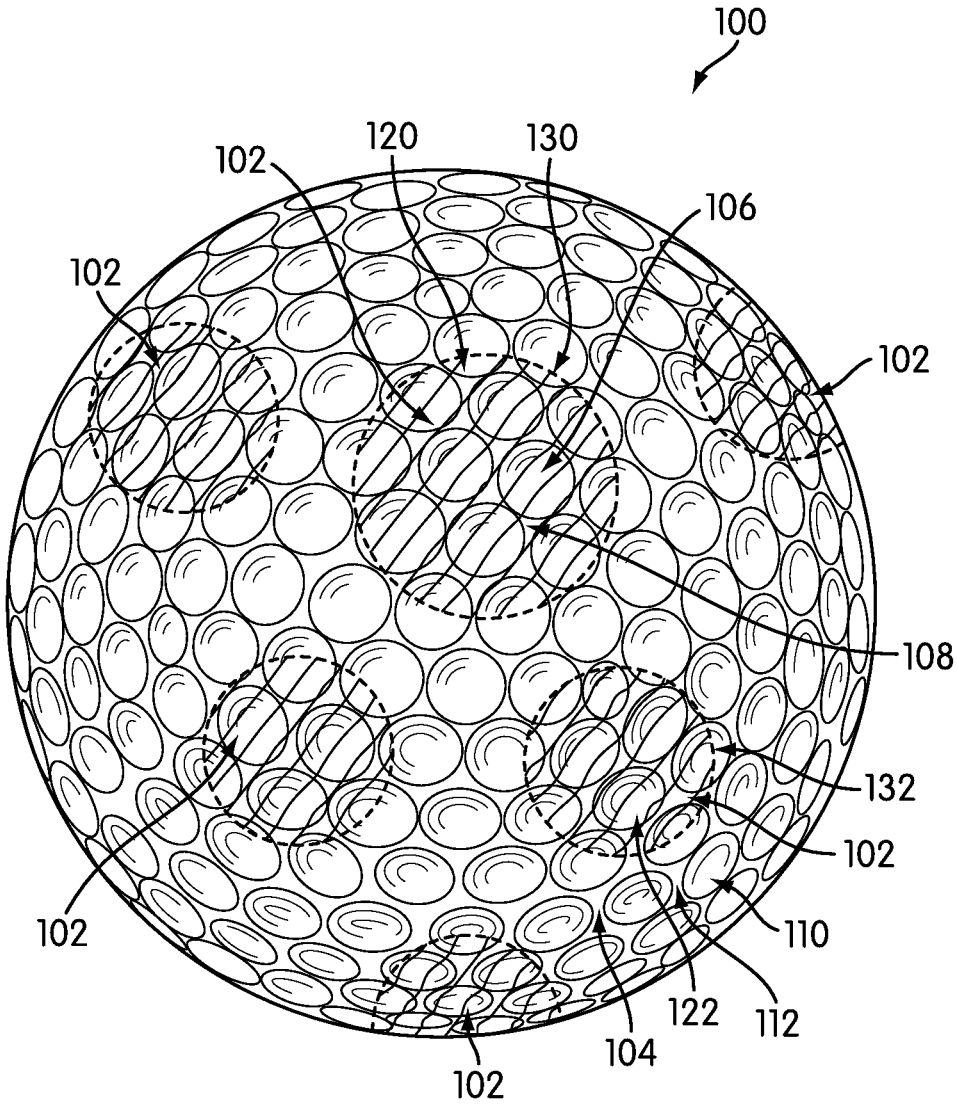
FIG. 1 shows an exemplary golf ball having several circular zones of differing hardness.

FIG. 1 shows an exemplary golf ball 100 in accordance with this disclosure. Golf ball 100 includes a cover layer made up of a first portion 102 and a second portion 104. First portion 102 consists of multiple non-contiguous zones, such as representative zone 120 and representative zone 122. Each zone making up first portion 102, such as zone 120 or zone 122, is surrounded by second portion 104. The cover layer also includes a plurality of dimples thereon, and at least one land area separating the dimples. Specifically, first portion 102 includes dimples 106 thereon, as well as land area 108 separating dimples 106. Similarly, second portion 104 includes dimples 110 thereon, as well as land area 112 separating dimples 110.

Golf ball 100 may generally be any type of golf ball having a core and a cover layer substantially surrounding the core. For example, golf ball 100 may be of a two-piece construction, having only a core and a cover layer, or golf ball 100 may have one or more intermediate layers located between the core and the cover layer. Throughout the several figures, golf ball 100 is shown as a three-piece construction. However, golf balls within the scope of this disclosure may also be of a two-piece construction, or have additional intermediate layers between the core and cover layer.

The plurality of dimples may generally be arranged on the cover layer in any pattern, as may be known in the art of golf balls. Various known dimple packing patterns are known in the art. Dimples 106 and dimples 110 may generally be of any shape, such as circular, triangular, or multi-sided. Dimples 106 and dimples 110 may be of uniform shape and size, or the dimple pattern may be made up of two or more different types of dimples having (for example) different sizes or different shapes.

Generally, a land area is defined as a part of the cover layer that separates at least two dimples and that is not indented or otherwise part of a dimple. For example, land area 108 is the "ridge" or "fret" between adjoining dimples 106. Land area 108 and land area 112 may be portions of one continuous land area across the entire face of the cover layer, as is shown in FIG. 1. Alternatively, each land area separating two or more dimples may be a separate land area. For example, land area 108 in each zone making up first portion 102 may be made up of several discrete land areas, each dividing two or more dimples 106.

Figure 2:
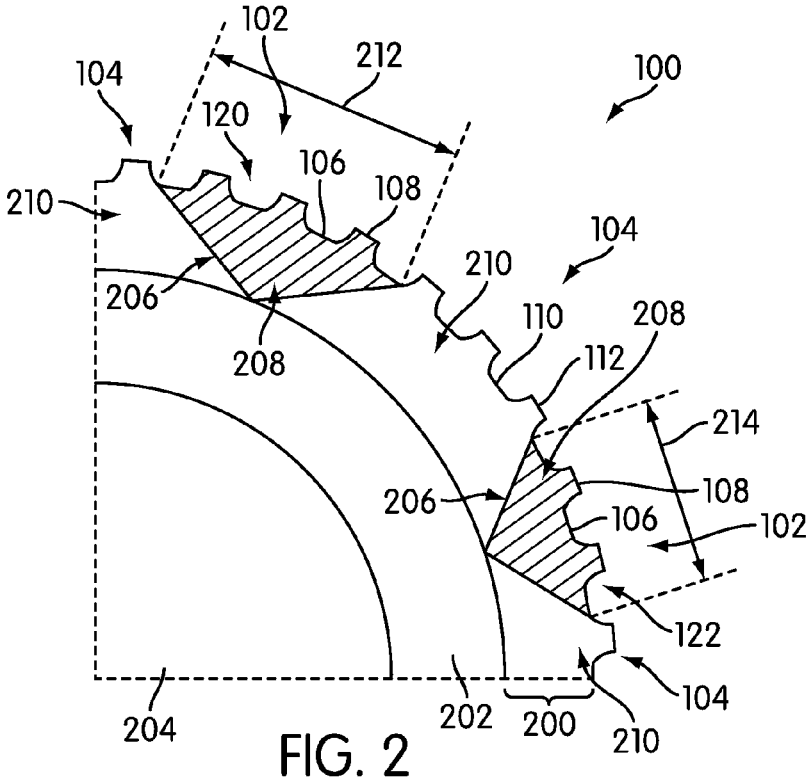
FIG. 2 shows a cross section of the golf ball, where each zone has a triangular shaped cross section.

FIG. 2 shows a cross section of a quarter of substantially spherical golf ball 100. In the embodiment shown, golf ball 100 is generally made up of cover layer 200, intermediate layer 202 and core 204. However, in other embodiments, intermediate layer 204 may not be present, or additional intermediate layers may be added. FIG. 2 shows representative zone 120 and representative zone 122 in particular detail. Zone 120 and zone 122 are parts of first portion 102, while portion 104 is shown surrounding them. As was mentioned with respect to FIG. 1, first portion 102 includes dimples 106 and land areas 108 thereof, while section portion 104 includes dimples 110 and land areas 112 thereon. In FIG. 2, the dimple pattern 106 on zone 120 is the same as the dimple pattern 106 on zone 122, however in other embodiments different zones may have different dimple patterns thereon.

Each of the zones making up first portion 102 may have any of a variety of shapes. FIG. 2 shows an embodiment where zone 120 has a diameter 212 and zone 122 has a diameter 214. In this embodiment, diameter 214 is less than diameter 212. For the purposes of discussion, the cross sectional "slice" shown in FIG. 2 is considered to cross the center of each zone in this embodiment. However, in other embodiments, each zone making up first portion 102 may have the same diameter, or the zones may have any relationship among their diameters.

Each zone making up first portion 102 also has a cross sectional shape 206. The cross sectional shape is a vertical cross section, vertically from the center of golf ball 100 outwards toward cover layer 200. In the embodiment shown in FIG. 2, cross sectional shape 206 is triangular. Triangular cross sectional shape 206 defines the boundary between area 208 of the first portion and areas 210 of the second portion. All of the multiple zones making up first portion 102 may have the same cross sectional shape, as zone 120 and zone 122 are shown both having triangular cross sectional shapes 206. Alternatively, each of the multiple zones making up first portion 102 may independently have different shapes, or any subset thereof may have any combination of cross sectional shapes.

Figure 3:
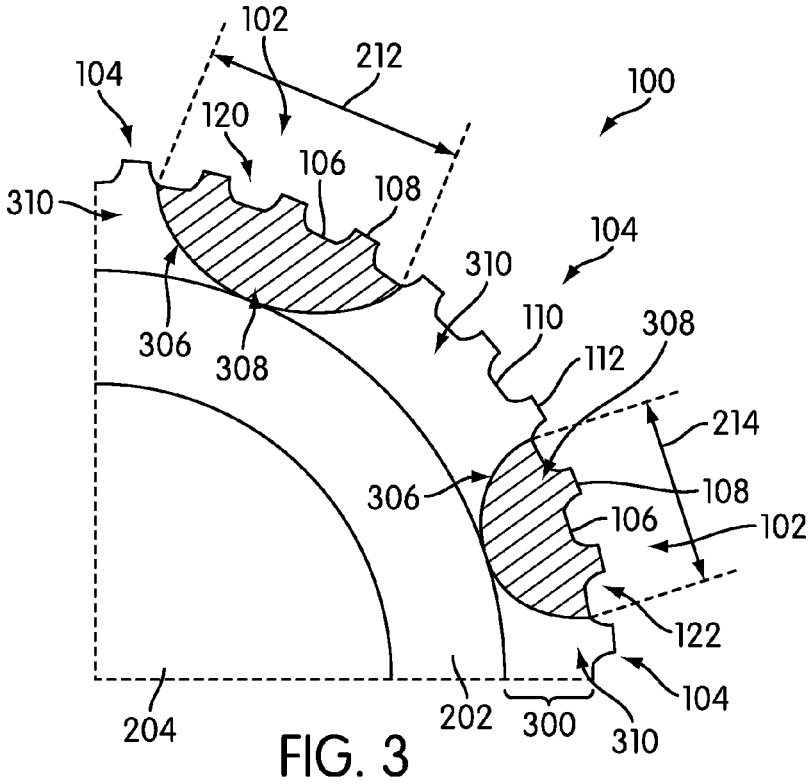
FIG. 3 shows a cross section of the golf ball, where each zone has a hemispherical shaped cross section.

FIG. 3 shows an alternative embodiment of a cross sectional shape 306. In this embodiment, golf ball 100 is made up of cover layer 300, as well as intermediate layer 202 and core 204. In this embodiment, cross sectional shape 306 is generally hemispheric. Cross sectional shape 306 may also be characterized as curved, catenary or parabolic. Hemispheric cross sectional shape 306 defines the boundary between area 308 of the first portion and areas 310 of the second portion. As shown in FIG. 3, the shape of areas 310 are also, of course, curved so as to fit with hemispheric cross sectional shape 306.

Figure 4:
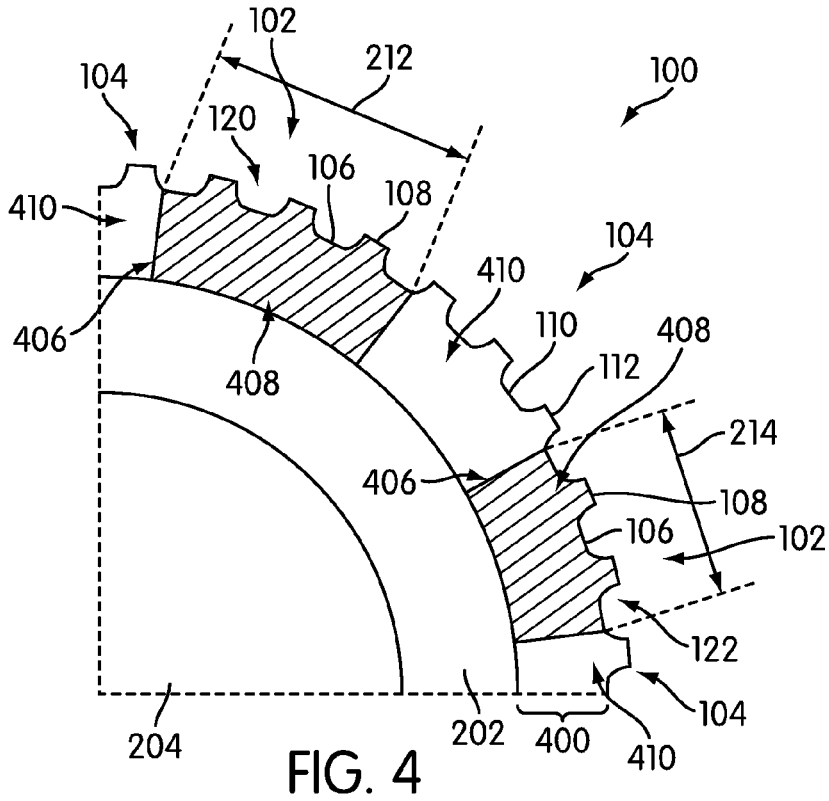
FIG. 4 shows a cross section of the golf ball, where each zone has a rectangular shaped cross section.
Figure 5:
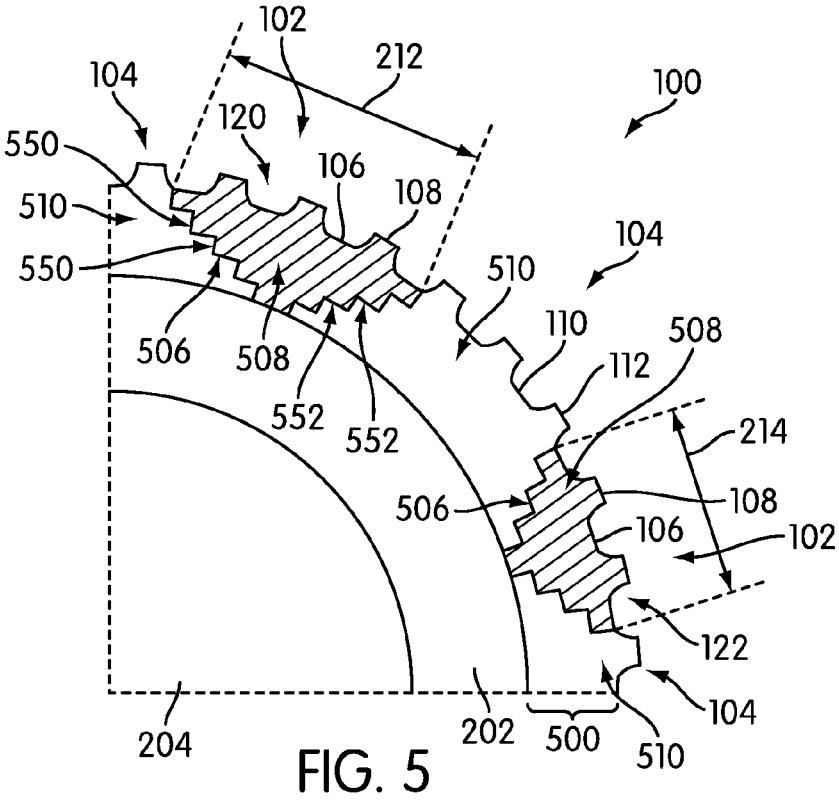
FIG. 5 shows a cross section of the golf ball, where each zone has a incrementally stepped triangular shaped cross section.

Further embodiments of cross sectional shapes are shown in FIGS. 4 and 5. Specifically, FIG. 4 shows an embodiment having a rectangular cross sectional shape 406. Rectangular cross section 406 may also be characterized as a square cross sectional shape, when the diameter of the zone is approximately equal to the thickness of cover layer 400. In various other embodiments (as can be seen in FIGS. 2, 3 and 5), parts of areas associated with first portion 102 may overlap parts of areas associated with second portion 104. For example, area 208 overlaps area 210, and area 308 overlaps areas 310. However, in embodiments having rectangular cross sectional shapes 406, no part of area 408 overlaps area 410.

In a final exemplary embodiment of a cross sectional shape, FIG. 5 shows cross sectional shape 506 in the form of an incrementally stepped triangle. Cross sectional shape 506 may also be characterized as being an inverted pyramid. Generally, cross sectional shape 506 includes vertically rising sections 550 and horizontally rising sections 552, which together form a series of "steps." Incrementally stepped triangle cross sectional shape 506 separates area 508 of first portion 102 from area 510 of second portion 104 in cover layer 500. This embodiment creates increased surface area between area 508 and area 510, which may be advantageous during manufacturing of golf ball 100 if the first portion is formed from a separate material than the second portion (as discussed below).

In addition to the cross sectional shape, each zone making up first portion 102 may also have a perimeter shape. FIG. 1 shows each zone having a generally circular perimeter shape. Specifically, zone 120 includes circular perimeter 130, and zone 122 includes circular perimeter 132. Namely, as discussed above with respect to FIG. 2, zone 120 has diameter 212 as defined by perimeter 130, and zone 122 has diameter 214 as defined by perimeter 132. Although FIGS. 1-5 show zone 120 and zone 122 as having different diameters, each of the multiple zones making up first portion 102 may have generally the same diameter, or any subset of the zones making up first portion 102 may have any combination of different diameters.

Figure 6:
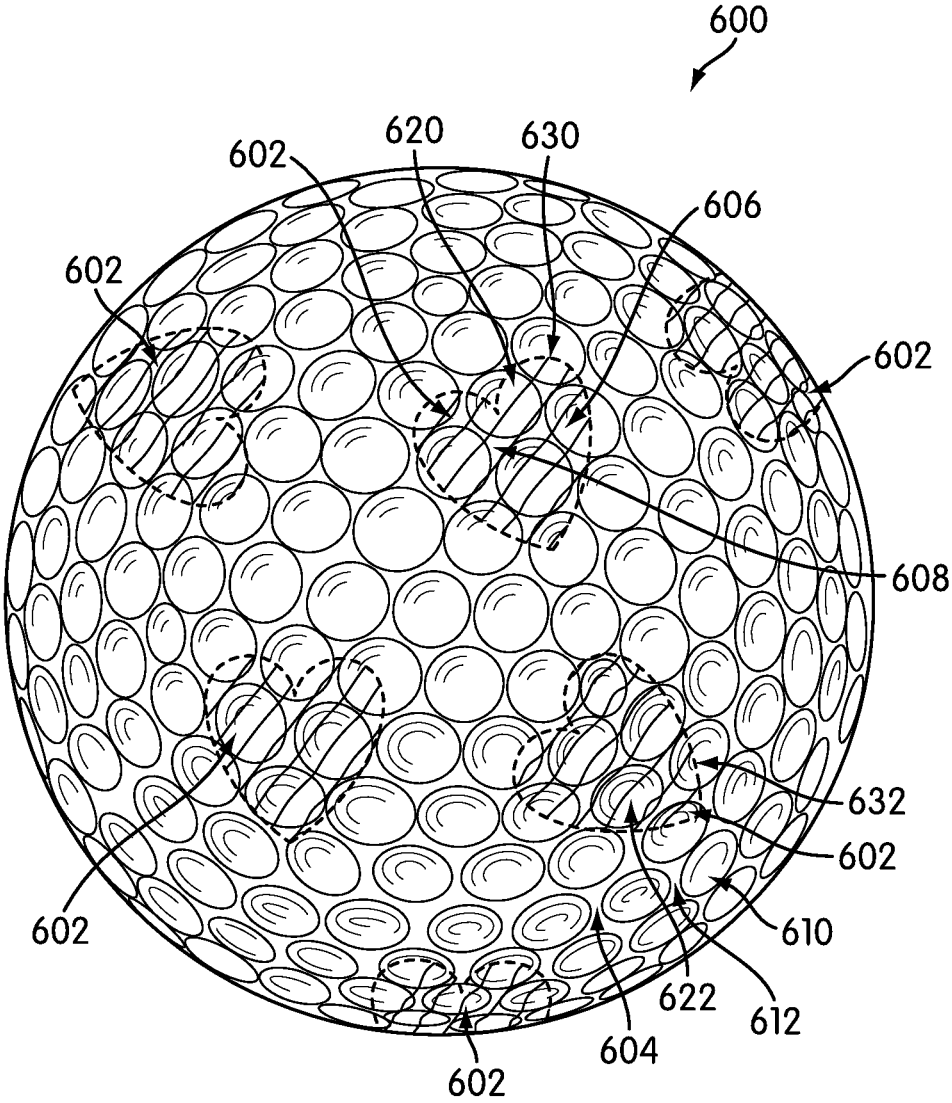
FIG. 6 shows an exemplary golf ball having several zones of differing hardness in the shape of a graphic.

FIG. 6 shows a second embodiment of a perimeter shape. In FIG. 6, golf ball 600 includes first portion 602 and second portion 604, where first portion 602 is comprised of a plurality of non-contiguous zones. Specifically, first portion 602 may include exemplary zone 620 and exemplary zone 622. As in FIG. 1, first portion 602 includes dimples 606 and land areas 608 thereof, while second portion 602 includes dimples 610 and land areas 612 thereon.

Generally, the perimeter shape may be any geometric shape, such as a circle, triangle, rectangle or polygon having five or more sides. Furthermore, the perimeter shape may be in the form of a graphic. A graphic is generally understood to mean a pictorial representation of a concept or thing. In the embodiment shown in FIG. 6, the perimeter shape is in the form of a heart. Specifically, zone 620 includes perimeter shape 630 in the form of a heart, and zone 622 includes perimeter shape 632 in the form of a heart. Such perimeter shapes may be, for example, decorative or identifying. For example, the perimeter shape may be in the form of a trademarked logo, or a customized graphic such as a golfer's initials.

Although all of the zones making up first portion 602 of golf ball 600 are shown in FIG. 6 as being heart shaped, in other embodiments each of the multiple zones may have different perimeter shapes. For example, a golf ball may includes a cover layer wherein certain of the multiple zones have a circular perimeter shape, others have a novelty graphic perimeter shape and yet others have a perimeter shape in the form of a logo, or any combination thereof.

In such embodiments, first portion 602 may be colorized differently from second portion 604, in order to ensure that the various perimeter shapes discussed above are visible. In some embodiments, this coloration may be achieved by using a different material for first portion 602 than for second portion 604, as discussed below. Alternatively, a difference in coloration may be achieved by selectively painting or dying first portion 602 or section portion 604 in accordance with the perimeter shapes.

Figure 7:
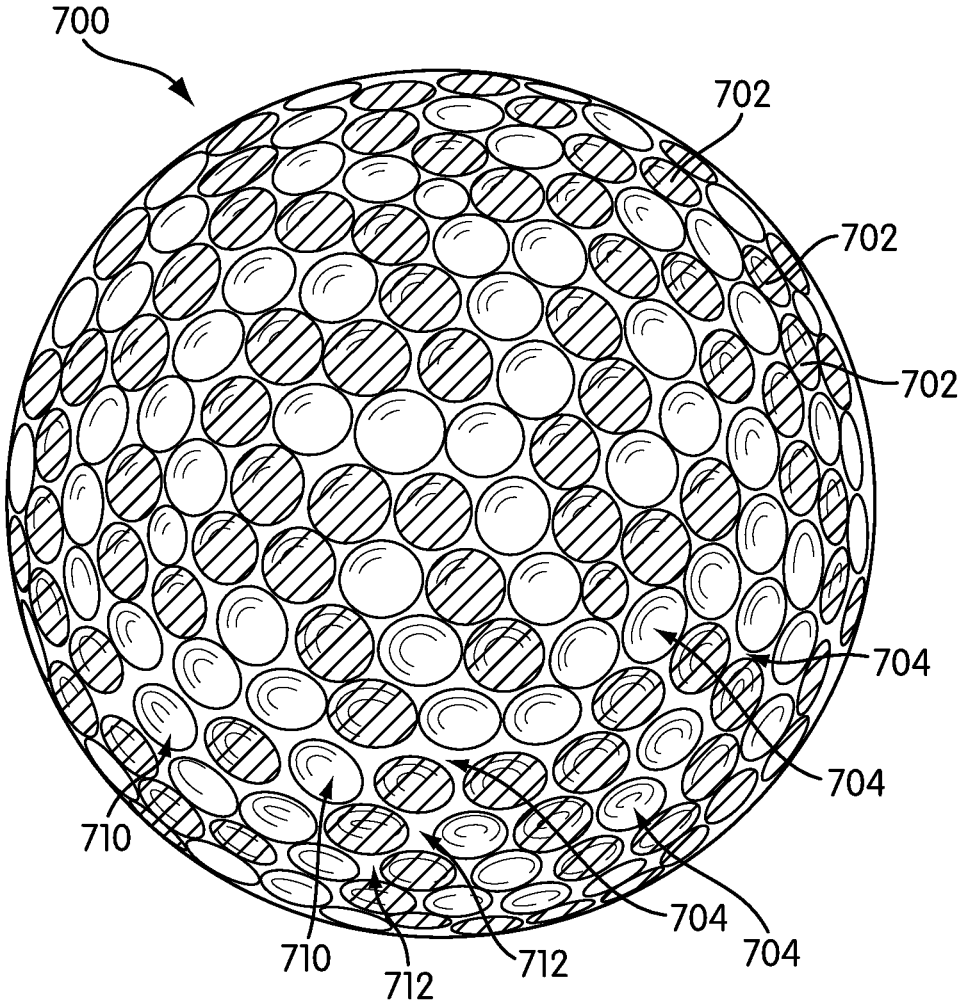
FIG. 7 shows an exemplary golf ball wherein several zones of differing hardness are associated with certain of the plurality of dimples.

FIG. 7 shows an embodiment wherein the first portion 702 is associated with at least some of the plurality of dimples on the cover layer of golf ball 700. Specifically, each of the zones making up first portion 702 is associated with one out of the plurality of dimples. In other words, each zone is coextensive with the boundaries of a single dimple. Therefore, as shown in FIG. 7, first portion 702 includes only dimples thereon, while second portion 704 includes other dimples 710 as well as land areas 712 thereon. First portion 702 may generally include any number out of the plurality of dimples, except as otherwise discussed below.

Figure 8:
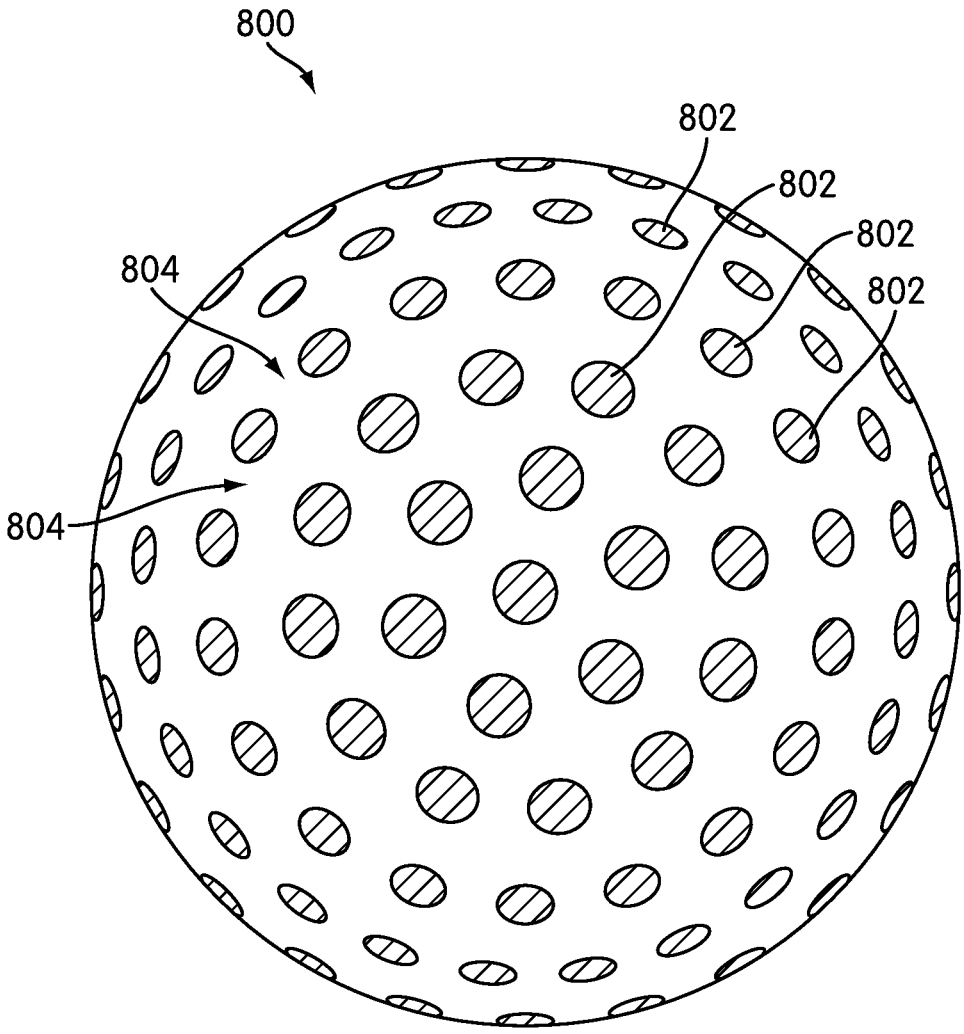
FIG. 8 shows an exemplary golf ball wherein each of the plurality of dimples is associated with a zones of differing hardness.

In particular embodiments, the first portion may include all of the plurality of dimples thereon. FIG. 8 shows an example of such an embodiment. Golf ball 800 includes a dimple pattern having a plurality of dimples on its cover layer. First portion 802 is entirely associated with the dimples, while second portion 804 is entirely associated with the land area separating the dimples.

In any of the embodiments shown in FIGS. 1, 6, 7 and 8, the first portion and the second portion may be arranged on the cover layer in any of various patterns. Generally, the zones may be of any size and placement on the cover layer. In certain embodiments, the zones may be located on the cover layer in a random pattern. In other embodiments, the zones may be sized and located on the cover layer in a pattern such that the cover layer is spherically symmetric, in accordance with USGA regulations.

Importantly, in each of the above discussed embodiments, the first portion has a first hardness and the second portion has a second hardness. The first hardness and the second hardness are different. The degree of difference in hardness between the first portion and the second portion may generally be any non-trivial difference in hardness. As discussed herein, all hardness values are given in the Shore D scale, and (unless stated otherwise) are measured on the golf ball. The difference in hardness between the first hardness and the second hardness creates zones of hardness that give rise to advantageous play characteristics.

In certain embodiments, the difference between the first hardness and the second hardness is at least 3 units on the Shore D scale. In other embodiments, the difference between the first hardness and the second hardness is at least 5 units on the Shore D scale. In yet other embodiments, the difference between the first hardness and the second hardness is at least 10 units on the Shore D scale. The first hardness may be harder than the second hardness, or alternatively the second hardness may be harder than the first hardness.

The first hardness and the second hardness are each independently within the range of at least about 30 to at most about 75 on the Shore D scale. In certain embodiments, first hardness and the second hardness are each independently within the range of at least about 40 to at most about 75 on the Shore D scale.

Hard cover layers are generally associated with longer flight distances, such that hard cover layers better achieve long shots off the tee. In contrast, softer cover layers are generally associated with better "feel," i.e., better control over the ball during flight and landing due to increased spin on the ball. The present disclosure achieves a balance between these otherwise mutually exclusive play characteristics by incorporating both softer and harder portions into the cover layer. For example, in an embodiment wherein the first portion is harder and the second portion is softer, a golf club face will impact both the harder zones of the first portion and the softer continuous second portion. The ball will therefore exhibit play characteristics associated with both hard cover layers and soft cover layers.

Also importantly, in each of the above discussed embodiments, the golf ball has a total surface area of the cover layer. The first portion and the second portion occupy a specific amount of the total surface area of the golf ball's cover layer. The total surface area of the cover layer is equal to the sum of the surface area of the first portion and the surface area of the second portion. The first portion may encompass at least 20% of the total surface area of the cover layer, in certain embodiments. The first portion may also encompass at most 60% of the total surface area of the cover layer, in certain embodiments. In other words, the first portion may occupy 20% to 60% (inclusive) of the total surface area of the cover layer, while the second portion may occupy 80% to 40% of the total surface area of the cover layer.

In other embodiments, the first portion may encompass at least 30% of the total surface area of the cover layer. Finally, in yet other embodiments, the first portion may encompass at most 50% of the total surface area of the cover layer. In other words, the first portion may occupy 30% to 50% (inclusive) of the total surface area, while the second portion may occupy 70% to 50% of the total surface area.

Without wishing to be bound by any theory of action or particular effect, it is believed that this range of 20% to 60% of the total surface area allows the golf ball to achieve a balance between long flight distance and good feel. Namely, when the first portion and the second portion occupy the above discussed surface areas ratios, and are arranged on the cover layer such that a golf club face will encounter both the first portion and the second portion upon impact with the golf ball, the golf ball behaves as if it has both a softer cover and a harder cover. If the first portion having the first hardness occupies less than 20% of the total surface area, and the second portion having the second hardness occupies more than 80%, then the golf ball will merely exhibit the play characteristics associated with the second hardness without also exhibiting any of the play characteristics associated with the first hardness. Similarly, if the first portion having the first hardness occupies more than 60% of the total surface area, then the golf ball will merely exhibit the play characteristics associated with the first hardness without also exhibiting any of the play characteristics associated with the second hardness. It is believed that this arrangement allows the club face to compress the softer portion against the inner layers and core of the golf ball, so as to cause increased spin, while also transferring kinetic energy to the core through the harder portion, so as to cause longer distances off the tee.

Golf ball 100 may also have further physical properties that may be conducive to desirable play characteristics. For example, golf ball 100 may have a coefficient of restitution (COR) higher than 0.770 at a ball speed of 40 meters per second (m/s).

The materials comprising the first portion and the second portion, (except as otherwise herein noted) may be made from any of various materials known to be used in golf ball manufacturing. Generally, any part of a golf ball in accordance with this disclosure, or any subsection thereof, may be made from any of various materials known to be used in golf ball manufacturing, except as noted.

For example, each part of golf ball 100 (or any portion thereof) may be made from a thermoset material, a thermoplastic material or combinations thereof. In some embodiments, the material used in golf ball 100 may be made from a thermoset material, such as a rubber-like compound. Base rubbers include 1,4-cis-polybutadiene, polyisoprene, styrene-butadiene copolymers, natural rubber, and mixtures thereof. If greater resilience is desired, 1,4-cis-polybutadiene in particular may be used. Furthermore, 1,4-cis-polybutadiene may be used as the base material and mixed with other ingredients. The amount of 1,4-cis-polybutadiene may be at least 50 parts by weight, based on 100 parts by weight of the rubber compound.

Additionally, a base rubber material may further include additives, like a cross-linking agent and a filler, to increase the specific gravity. For example, the cross-liking agent includes zinc diacrylate, magnesium acrylate, zinc methacrylate, and magnesium methacrylate, wherein zinc diacrylate in particular may be used to achieve greater resilience.

Furthermore, in order to achieve a greater specific gravity, the rubber compound can include filler, such as zinc oxide, barium sulfate, calcium carbonate, and magnesium carbonate, wherein zinc oxide is preferable. Metal powders, such as tungsten, having a high specific gravity may also be included to reach a desired specific gravity. Other additives may also be included as may be known in the art of polymer chemistry and golf ball manufacturing.

The material of some or each part of the golf ball can be made from a thermoplastic material as well. For example, the material may comprise an ionomer resin, a polyamide resin, a polyester resin, a polyurethane resin, and any mixture thereof.

In certain embodiments, the first portion and the second portion may be made of the same material. For example, a single polymer material may be made to have different hardness values, as described variously above, by changing the crystalline structure of the polymer (when using certain thermoplastic polymer materials).

In certain embodiments, with reference to golf ball 800 shown in FIG. 8, the cover layer may comprise a phase transition material as described in U.S. Patent Application Publication No. 2008/0081710 (hereinafter referred to as "the '710 Publication"), the disclosure of which is hereby incorporated in its entirety. Specifically, the phase transition material described in the '710 Publication is an acid copolymer that comprises copolymerized residues of at least one alpha olefin having from two to six carbon atoms and copolymerized residues of at least one $\alpha,\beta$-ethylenically unsaturated carboxylic acid having from 3 to 8 carbon atoms.

As described in the '710 Publication, this phase transition material changes hardness in response to heating. Specifically, heat energy decreases the hardness by disrupting the material's secondary crystal structure. As is generally known in the arts of polymer science, the hardness of a semi-crystalline polymer material may be proportional to the degree of crystallinity of the polymer material. The degree of crystallinity is the amount of the material that is in a crystalline phase, as compared to the amount of the material that is in an amorphous phase. The crystalline phase is generally harder than the amorphous phase, due to the close-packing crystal structure of the polymer molecules therein.

Figure 9:
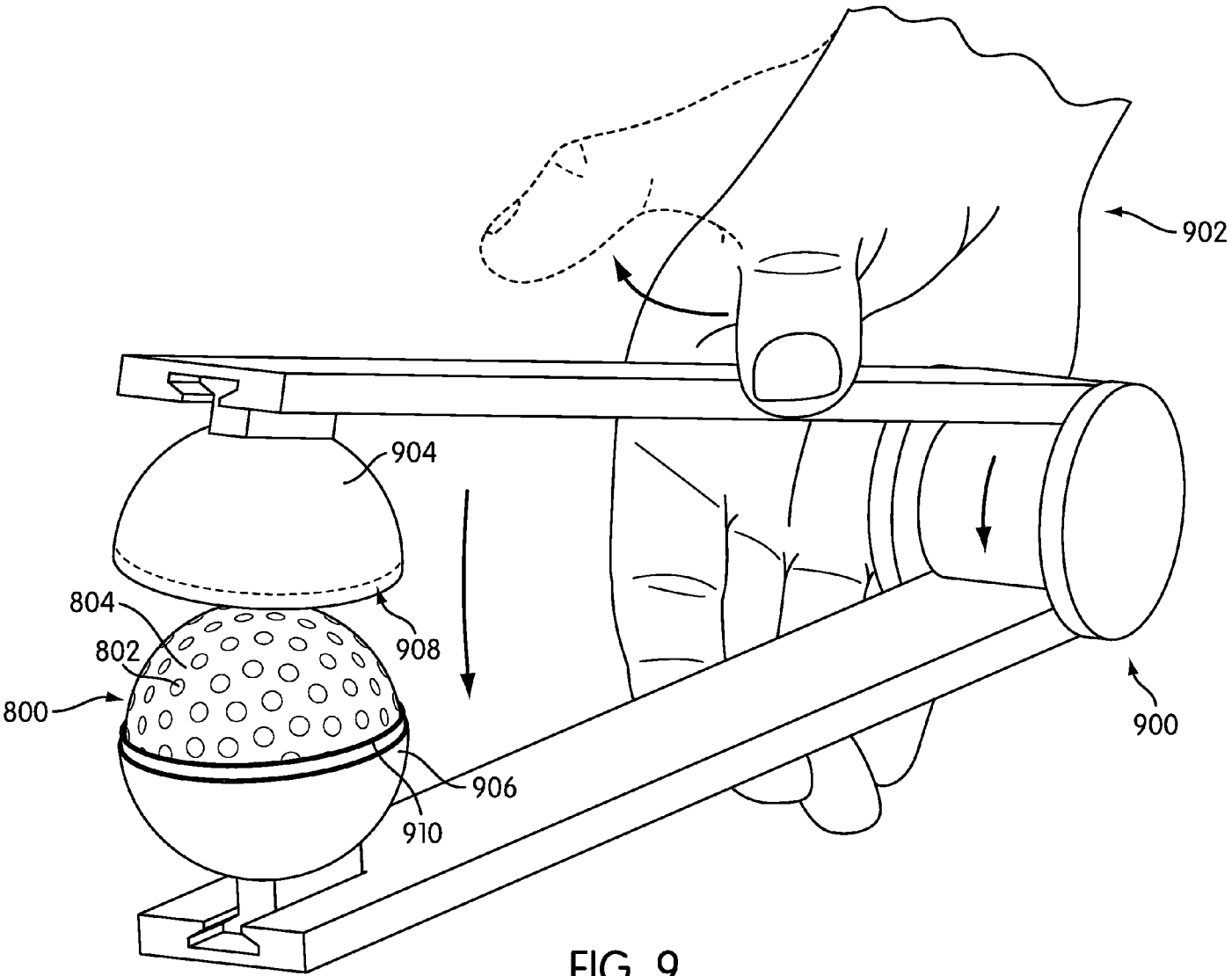
FIG. 9 shows a heating device which may be used to create the zones on the cover layer.

Therefore, golf ball 800 may be selectively heated in a heating device 900 as shown in FIG. 9 in order to achieve the desired difference in hardness. The heating device 900 is fully described in U.S. Pat. No. 8,283,603, entitled Device for Heating a Golf Ball, and filed on Oct. 23, 2009 (hereinafter, the "Heating patent"), the disclosure of which is hereby incorporated in its entirety. Heating device 900 is held by a user's hand 902 and moved, as shown, such that an upper heating surface 908 and a lower heating surface 910 are brought into contact with the golf ball 800.

Figure 10:
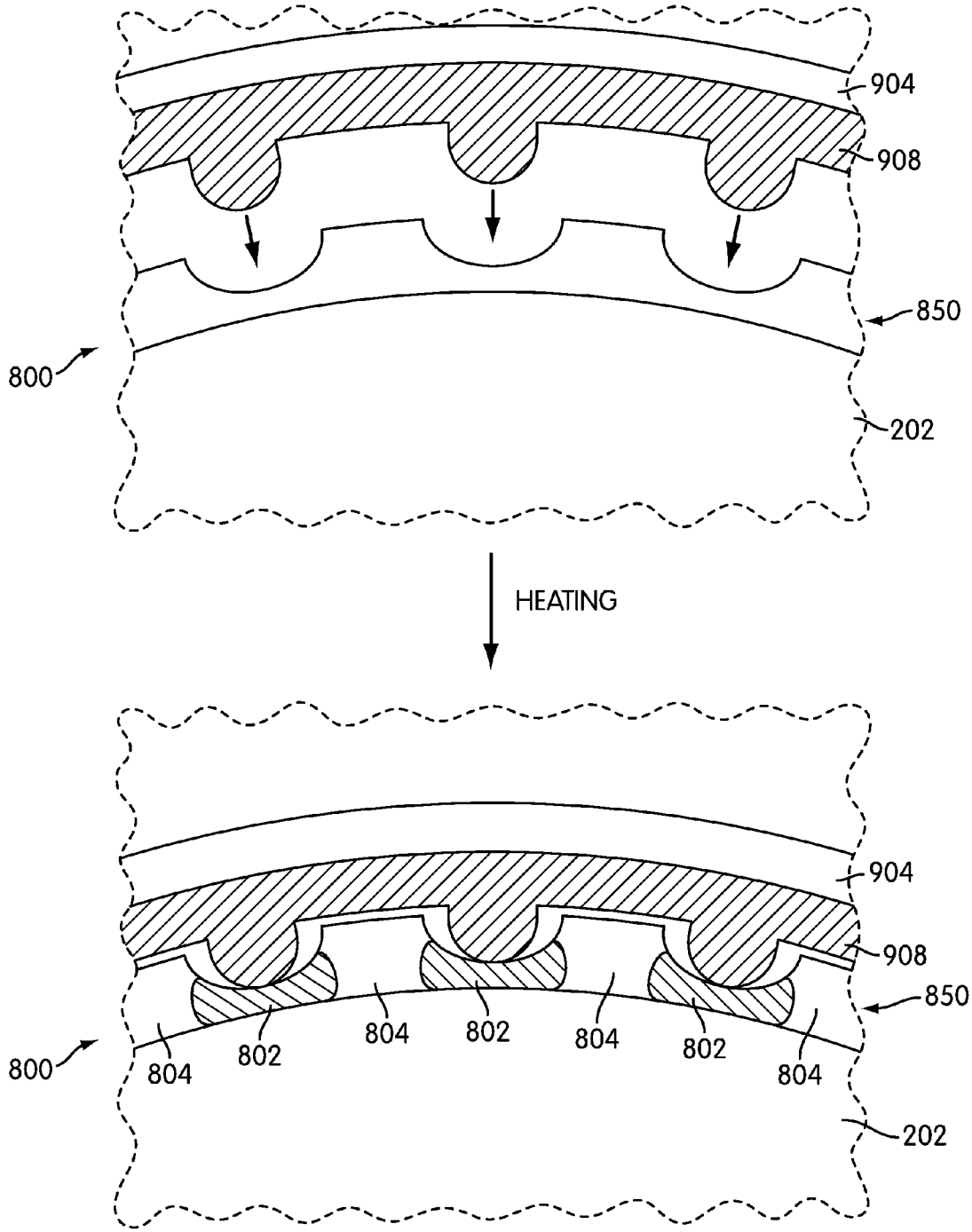
FIG. 10 shows a close-up cross section of a portion of the golf ball of FIG. 8, during a heating process.

Specifically, as is shown in FIG. 10, heating element 908 may be used to heat sections 802 of the cover layer 850 associated with the dimples. The heating element 908 may generally be any heating mechanism that is capable of selectively heating the desired portions of the cover layer. In a particular embodiment, as mentioned above and shown in FIG. 9, the heating element may be a component of the heating apparatus described fully in the Heating patent. In such embodiments, the heating element 908 may be the internal heating surface as described in the Heating patent. Similarly, the heating element backing 904, shown in FIGS. 9 and 10, may be the external housing described in the Heating patent. The device described in the Heating patent allows a consumer to create a desired difference in hardness in accordance with the present disclosure through the use of a particular pattern on the internal heating surface.

Although FIG. 10 only shows a selective heating process being applied to a particular cross section of the cover layer 850, this selective heating process may be applied to the entire surface of golf ball 800, such that all dimple areas 802 are heated. Alternatively, in accordance with the embodiment shown in FIG. 7, the selective heating process may be applied to certain dimple areas 702 on different locations on golf ball 700, but not others, as may be desired. In embodiments wherein cover layer 850 comprises a phase transition material as described in the '710 Publication, heating causes a decrease in hardness of the phase transition material. Therefore, first hardness associated with first portion 802 will be softer than second hardness associated with second portion 804.

In another embodiment wherein the first portion and the second portion are made from the same material, cover layer 850 may generally comprise a semi-crystalline thermoplastic material. Methods for changing the hardness of semi-crystalline thermoplastic materials are fully described in U.S. Patent Application Publication No. 2011/0177890, entitled Methods and Systems for Customizing a Golf Ball, and filed on Jan. 20, 2010, the disclosure of which is hereby incorporated in its entirety.

In accordance with the methods described in the '493 Application, sections 802 may be heated to increase the movement of the polymer molecules in the semi-crystalline thermoplastic material, and subsequently slowly cooled such that the degree of crystallinity in these sections 802 increases. Sections 802 therefore collectively make up first portion 802 of cover layer 850, as described above, and have a hardness that is different from the un-heated sections 804 collectively making up the section portion. In such embodiments, again, the degree of crystallinity of the first portion 802 of cover layer 850 is different from the degree of crystallinity of the second portion 804. In other words, the first portion has a first degree of crystallinity, and the second portion has a second degree of crystallinity, where the first degree of crystallinity is higher than the second degree of crystallinity. Accordingly, in these embodiments, the first hardness associated with first portion 802 is harder than the second hardness associated with second portion 804.

In different embodiments than those discussed variously above, the difference in hardness between the first portion and the second portion can be achieved through the use of two different materials. Specifically, the first portion may be made of a first polymer material having a first hardness, and the second portion may be made of a second polymer material having a second hardness.

For example, a wide range of polymers are known in the art that have various hardness values. The hardness of a polymer material may generally be controlled by, for example, the degree of cross-linking, the degree of crystallinity, and the chain length. Generally, the polymer coating material may be any thermoplastic, thermoset, ionomer, copolymer, or other polymer material known and used in the art of golf balls, as discussed above.

The two different materials may be entirely different types of materials, such as a polyurethane and a vinyl polymer. Alternatively, the two different materials may be the same generally type of chemical material but have different polymer structures (such as the degree of crosslinking, or the types and ratios of the monomers making up the polymer). For example, the first portion may comprise a thermoplastic polyurethane (TPU) having a hardness of about 55 on the Shore D scale, and the second portion may comprise a thermoplastic polyurethane having a hardness of about 65 on the Shore D scale. The first material making up the first portion, and the second material making up the second portion, may therefore both be TPU.

Figure 11:
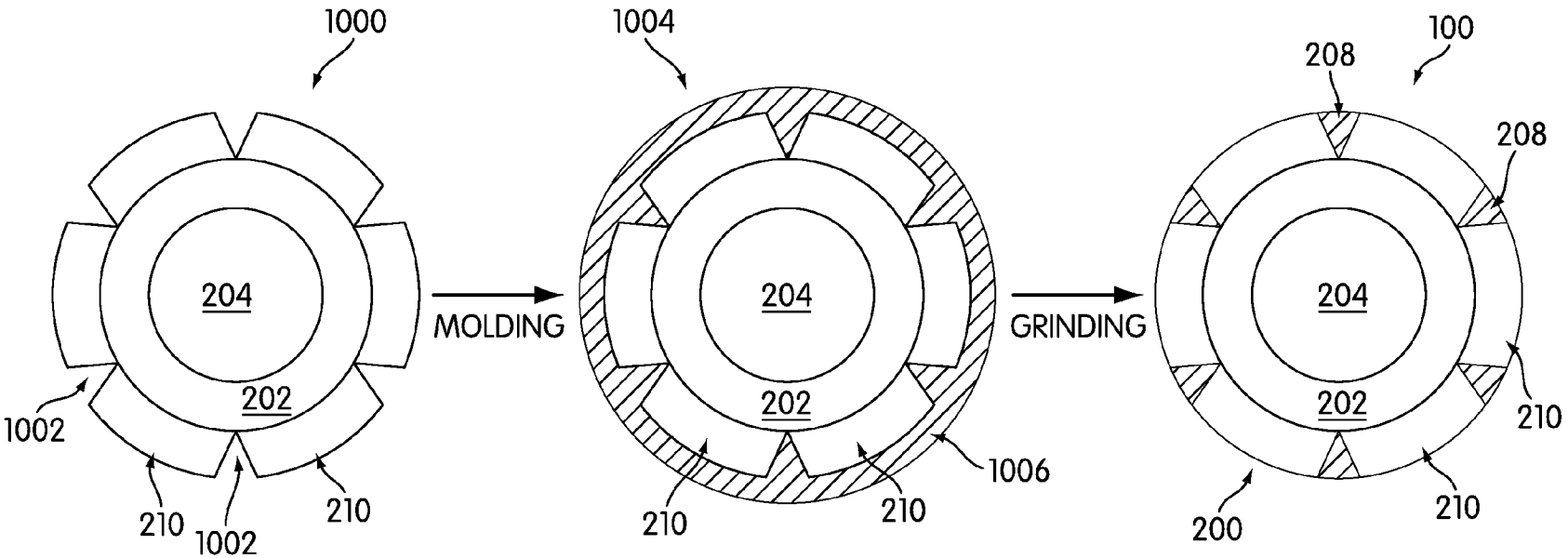
FIG. 11 shows a process for creating zones of hardness from two different materials.

FIG. 11 shows a method by which golf ball 100 may be manufactured from two different cover layer materials. Generally, a method of manufacturing a golf ball includes a first step 1000 of receiving a golf ball having core 204 and a pre-cover layer 210 substantially surrounding core 204. Pre-cover layer 210 may be formed of a first material having a first hardness, and may have multiple non-contiguous depressions 1002 therein arranged in a pattern corresponding to a desired pattern of zones. Depressions 1002 may be formed by drilling or using molds. The mold used in this step may be, for example, a conventional hot-press mold or an injection mold.

Next, in step 1002, a second material 1004 is molded on top of pre-cover layer 210, such that second material 1004 substantially surrounds pre-cover layer 210 and fills depressions 1002. Second material 1004 has a second hardness, which is different from the first hardness. Again, the molding may be done via compression molding or injection molding. The mold used in this step may generally take any shape, so long as depressions 1002 are filled by material 1004.

Finally, second material 1004 may be partially removed through, for example, any of various known physical or chemical removal processes. For example, second material 1004 may be partially removed through grinding. The grinding should remove sufficient quantities of second material 1004 such that second material 1004 overlaps pre-cover layer 210 only in depressions 1004, thereby forming a cover layer having multiple zones of second material.

After the grinding process, the surface of golf ball 100 may be cleaned and then using compression molding to create dimples on the surface thereof. After the dimples are made, the ball may undergo conventional finishing steps such as primer coating, stamping, and top coating.

The resulting golf ball 100 therefore achieves a first portion (formed from the second material) in the shape of multiple non-contiguous zones surrounded by a second portion (formed from the first material). As has been described above, the multiple zones of second material may encompass at least about 20% of a total surface area of the cover layer; and the multiple zones of second material may encompass at most about 60% of the total surface area of the cover layer.

Figure 12:
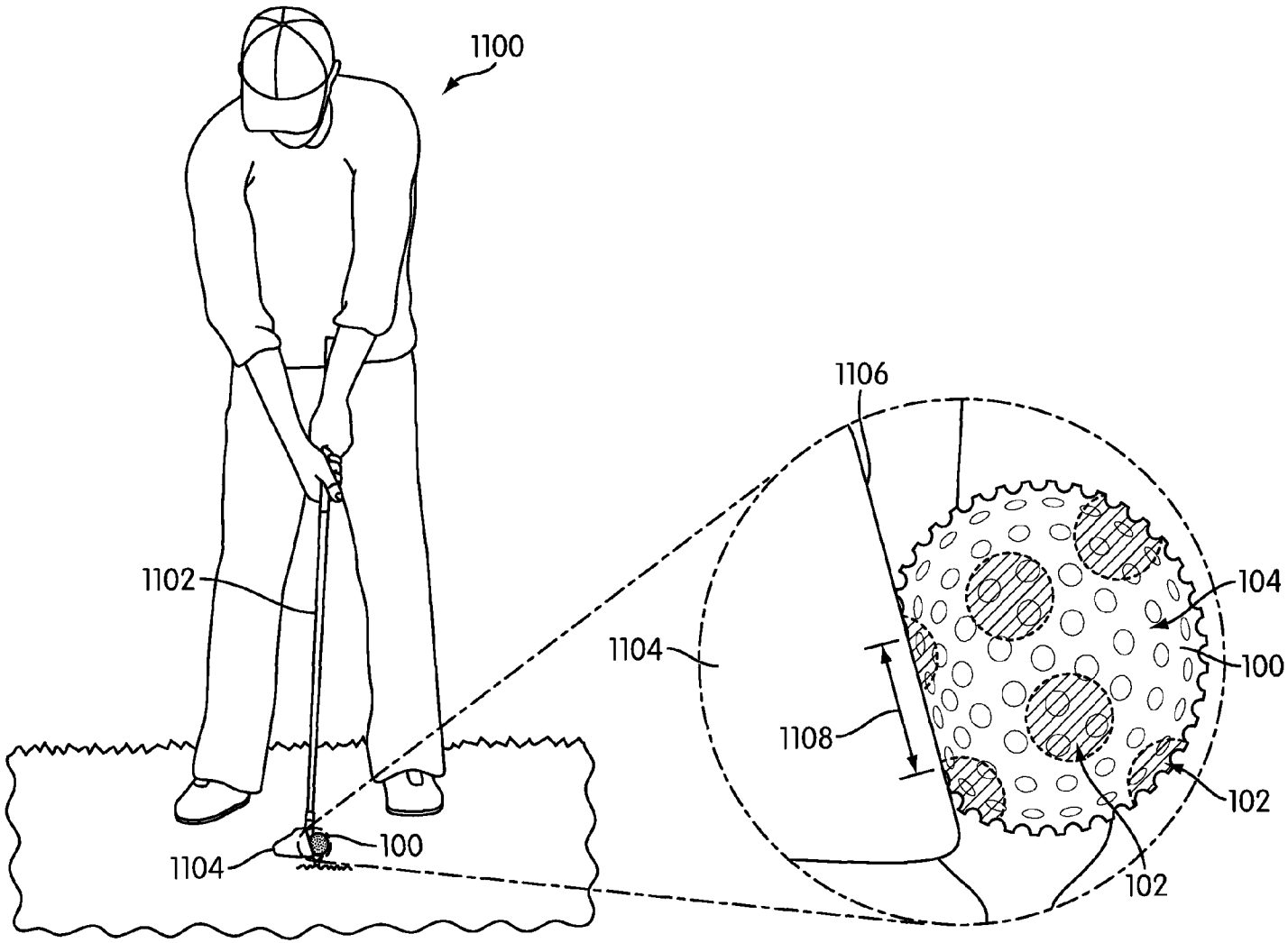
FIG. 12 shows a golfer hitting a golf ball with a driver, and a detailed view of the golf ball as it is being hit by the driver.

FIG. 12 shows golf ball 100 in use. A golfer 1100 swings a golf club 1102 toward golf ball 100. Golf club 1102 is a driver, having a large club head 1104, and a club face 1106 that is wide and has a low loft angle. As seen in the zoomed-in section of FIG. 12, the golf ball 100 includes first portion 102 and second portion 104 (as in FIG. 1).

As seen in the zoomed-in part of FIG. 12, the club face 1106 strikes the golf ball 100 with a large amount of force, in accordance with a driver. The golf ball 100 therefore deforms. Specifically, the golf ball 100 deforms such that a first area 1108 of the golf ball cover layer is flat against the club face 1106. In first area 1108, the club face 1106 impacts at least part of both first portion 102 and second portion 104, compressing them against core 204 (and intermediate layer 202). In this first area 1108 where at least part of both first portion 102 and second portion 104 are flat against the club face, the cover layer "appears" to have a hardness that is both soft and hard. By "appears" is meant: how the club face 1106 interfaces with the cover layer in this area.

Thus, due to the difference in hardness between the first portion and the second portion, the present golf ball exhibits play characteristics associated with both harder cover layers (such as increased flight distance) and play characteristics associated with softer cover layers (such as better feel and control).

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core; and a cover layer substantially surrounding the core;

the cover layer including a plurality of dimples thereon, and at least one land area separating the dimples;

a total surface area;

a first portion, the first portion of the cover layer having a first hardness;

a second portion, the second portion of the cover layer having a second hardness, the second hardness being different from the first hardness;

wherein the first portion consists of multiple non-contiguous zones each surrounded by the second portion;

wherein the first portion encompasses at least 20% of the total surface area of the cover layer; and the first portion encompasses at most 60% of the total surface area of the cover layer; and the first portion has a cross-sectional shape that extends from a first surface to a second surface, the first surface forming a portion of an upper surface of the cover layer, the second surface forming a portion of a lower surface of the cover layer, the lower surface of the cover layer being adjacent to an inner layer of the golf ball;

wherein the cross-sectional shape tapers to a point from the first surface to the second surface such that the first portion overlaps the second portion proximate the second surface; and wherein the first hardness is harder than the second hardness.

2. The golf ball according to claim 1, wherein each zone comprising the first portion has a perimeter shape, and the perimeter shape is selected from the group consisting of a circle, a triangle, a rectangle, a polygon having five or more sides, a graphic, and a logo.

3. The golf ball according to claim 1, wherein the cross sectional shape is selected from the group consisting of a triangle, a hemisphere, and an incrementally stepped triangle.

4. The golf ball according to claim 1, wherein each of the multiple zones is associated with one of the plurality of dimples.

5. The golf ball according to claim 4, wherein the first portion of the cover layer includes all of the plurality of dimples thereon, and the second portion of the cover layer includes an entirety of all of the land area(s) thereon.

6. The golf ball according to claim 1, wherein the first portion encompasses at least 30% of the total surface area of the cover layer.

7. The golf ball according to claim 1, wherein the first portion encompasses at most 50% of the total surface area of the cover layer.

8. The golf ball according to claim 1, wherein the first hardness is at least about 5 units on the Shore D scale different from the second hardness.

9. The golf ball according to claim 1, wherein the first hardness and second hardness are each from 30 to 75 on the Shore D scale.

10. The golf ball according to claim 1, wherein the zones are sized and arranged on the cover layer such that the golf ball is spherically symmetric.

11. The golf ball according to claim 1, wherein the first portion and the second portion consist of different materials.

12. The golf ball of claim 1, wherein the first portion and the second portion are both comprised of thermoplastic polyurethane.

* * * * *